US006098242A

United States Patent [19]

Choi

[11] Patent Number: 6,098,242

[45] Date of Patent: Aug. 8, 2000

[54] UPRIGHT VACUUM CLEANER

[75] Inventor: Kyung-Bae Choi, Kwangju, Rep. of Korea

[73] Assignee: Kwangju Electronics Co., Ltd., Kwangju, Rep. of Korea

[21] Appl. No.: 09/197,205

[22] Filed: Nov. 20, 1998

[30] Foreign Application Priority Data

Dec. 5, 1997 [KR] Rep. of Korea ..... 97-66434
Sep. 15, 1998 [KR] Rep. of Korea ..... 98-38057

[51] Int. Cl.[7] ..... A47L 5/34
[52] U.S. Cl. ..... 15/361; 15/351
[58] Field of Search ..... 15/351, 361

[56] References Cited

U.S. PATENT DOCUMENTS 4,217,674 8/1980 Hayashi et al. ..... 15/361
4,831,683 5/1989 Kroll et al. ..... 15/361

*Primary Examiner*—Theresa T. Snider
*Attorney, Agent, or Firm*—Burns, Doane, Swecker & Mathis, L.L.P.

[57] ABSTRACT

An upright vacuum cleaner includes a suction apparatus and a body pivotably mounted to the suction apparatus. The suction apparatus includes a suction opening and a rotatably driven dust agitator. The body includes a suction motor, support wheels, and a manually grippable handle. The body is swingable downwardly relative to the suction apparatus from an upright position to a normal use position, whereupon the height of a gap between the suction opening and a floor surface is minimized to promote effective cleaning. If the body is swung further downwardly past the normal use position, the height of the gap is prevented from changing, so the effective cleaning is maintained.

5 Claims, 10 Drawing Sheets

UPRIGHT VACUUM CLEANER

BACKGROUND OF THE INVENTION

1. Field of the Invention

The present invention relates to an upright vacuum cleaner.

2. Description of the Prior Art

Generally, an upright vacuum cleaner cleans the floor surface by sucking foreign objects. As illustrated in FIGS. 1, 2, 3 and 4, a prior art vacuum cleaner disclosed in U.S. Pat. No. 4,217,674 includes a suction apparatus 10 constructed to clean the floor surface by rotating an agitator 11 connected to a motor shaft A via a rubber belt B and implanted with brushes. The apparatus 10 is supported by left and right auxiliary front wheels 12. A body 20 is rotatably mounted to the suction apparatus 10 and is supported via rear wheels 21 disposed at left and right sides thereof. Dust is sucked through the suction apparatus 10 according to suction force. A handle member 30 is arranged at an upper portion of the body 20 for being pushed and pulled by a user, and a suction hose 40 mounted to the body 20 and the apparatus 10 for conducting the sucked-in dust.

When electric power is applied to activate driving means (not shown) in the body 20, and the handle member 30 is pushed forward or pulled backward at a predetermined angle, the wheels 21 at the body 20 are rotated and when, as illustrated in FIG. 4, when an angle formed by the body 20 and the floor surface is changed from 90 degrees to 38.7 degrees, (i.e., a normal use position) a gap between a suction opening of the suction apparatus 10 and the floor surface is also changed from (F) to (E) in FIG. 4. That occurs because the rear wheel 21 moves forwardly to a position beneath the shaft A, causing the shaft A, and thus the suction apparatus 10, to raise up and produce a corresponding lowering of the front portion of the apparatus 10 as the apparatus 10 rotates counterclockwise about the axis of front wheels 12. In other words, when the cleaning is performed at this time, cleaning efficiency is improved because the agitator 11 is rotated at the closest distance from the floor surface.

Thereafter, when the body 20 is again rotated to a position of 90 degrees, the gap (F) is recreated.

SUMMARY OF THE INVENTION

However, there is a problem in an upright cleaner thus constructed in that cleaning efficiency is reduced when an angle formed by the body 20 and the floor surface is changed from 38.7 degrees to 17 degrees, in order to enable the cleaner to fit into areas of low height. That problem occurs because the wheels 21 move further forwardly and thus away from a position beneath the shaft A, whereupon the rear portion of the apparatus swings downwardly, and the front portion swings upwardly to enlarge the gap between the suction opening and the floor surface, as is represented in solid lines in FIG. 9.

The present invention is disclosed to solve the aforementioned problem and it is an object of the present invention to provide an upright cleaner constructed and arranged to improve suction efficiency by preventing the height of a gap formed between a suction opening and a floor surface from being changed even though an angle formed by a body of the upright cleaner and the floor surface is further reduced after the gap has been minimized during downward swinging of the body to a use position.

In accordance with the object of the present invention, there is provided an upright cleaner, the cleaner comprising:

a suction apparatus through which foreign objects are sucked;

a body rotatably coupled to the suction apparatus and movable via wheels disposed on left and right sides thereof for collecting dust and the like sucked through the suction apparatus according to suction force of driving means; and a height adjustable apparatus cooperatively disposed between the suction apparatus and left and right sides of the body for preventing the height of a gap formed between a suction opening and a floor surface from being changed even though an angle formed by a body of the upright cleaner and the floor surface is further reduced after the gap has been minimized during downward swinging of the body to a normal use position.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
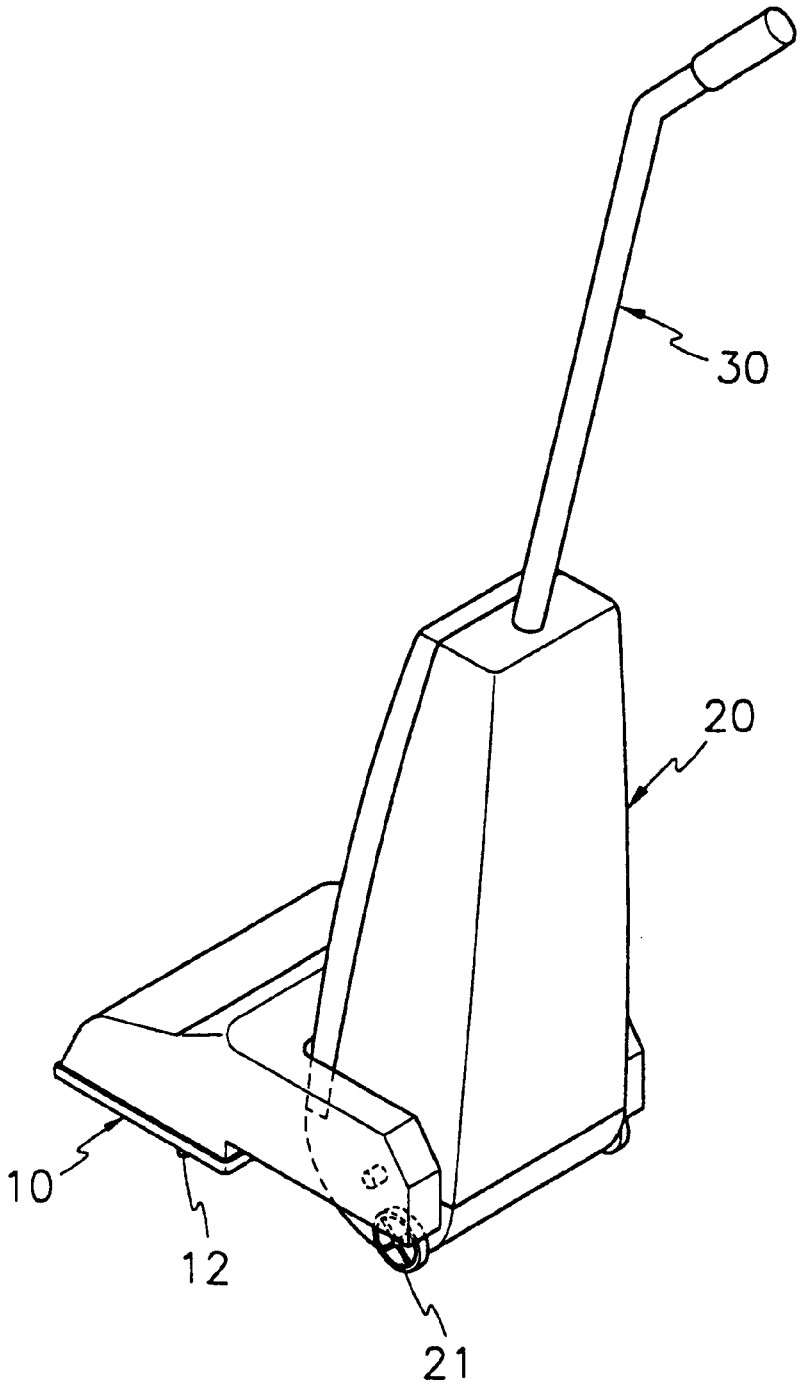
FIG.1 PRIOR ART
FIG. 1 is a perspective view for illustrating an upright cleaner according to the prior art.
Figure 2:
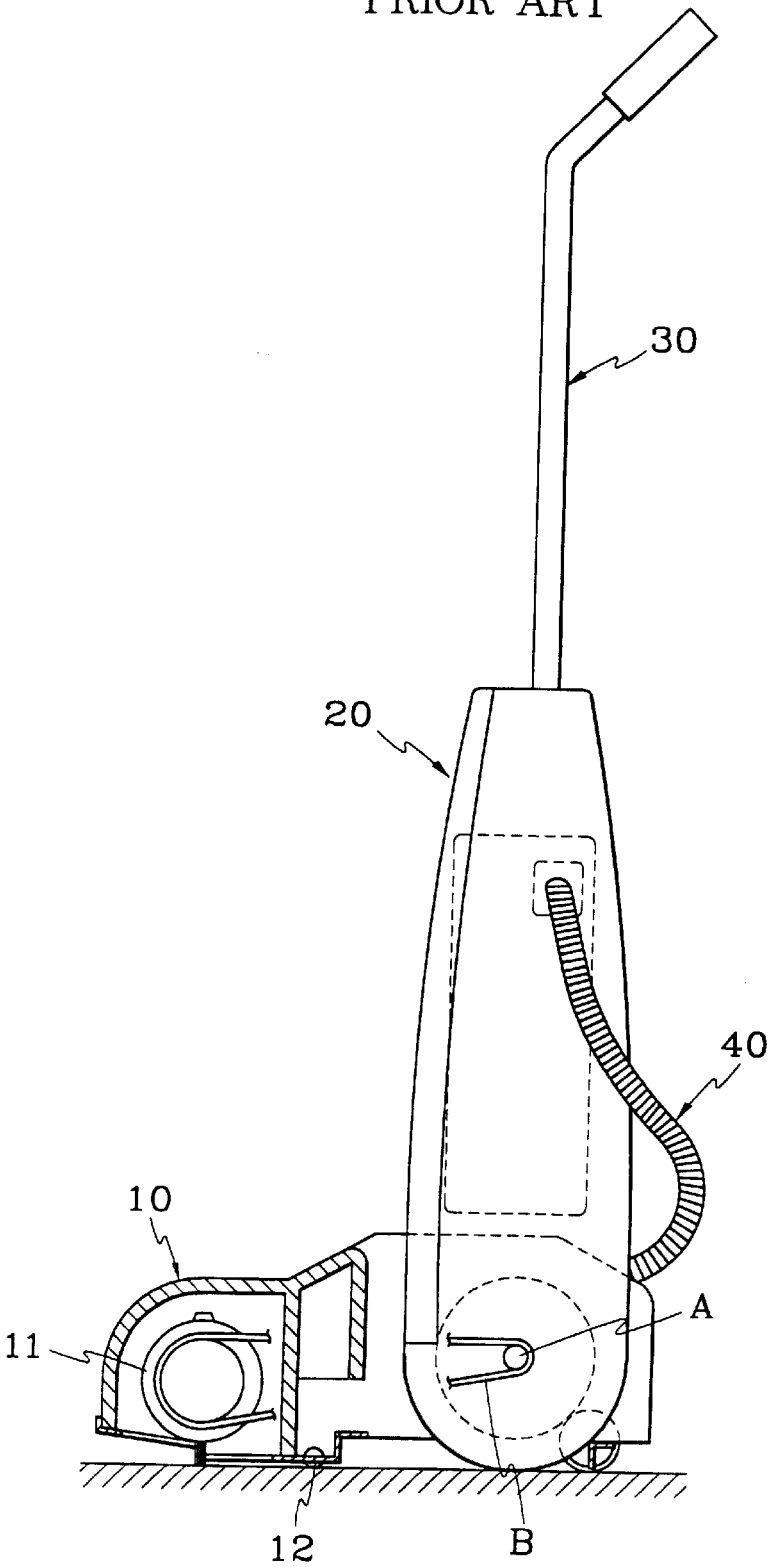
FIG.2 PRIOR ART
FIG. 2 is a front view for illustrating a partial section of an upright cleaner according to the prior art.
Figure 3:
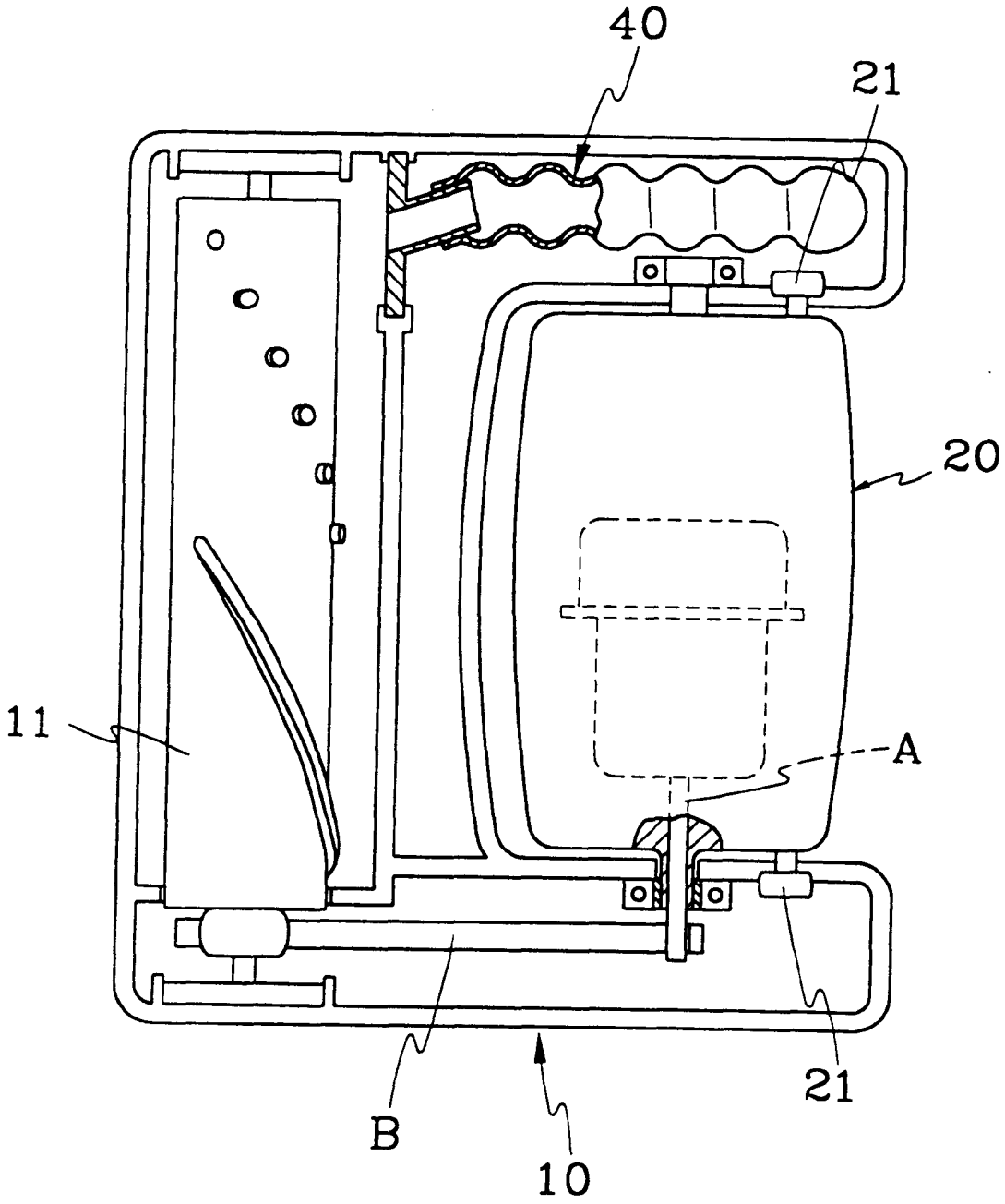
FIG. 3 PRIOR ART
FIG. 3 is a sectional view for illustrating a bottom side of an upright cleaner according to the prior art.

Two preferred embodiments of the present invention will now be described in detail with reference to the accompanying drawings.

The upright cleaner according to the present invention includes a suction apparatus 10 carrying an agitator 11 implanted with brushes and rotated via a rubber belt (B) connected to a motor shaft (A). The apparatus 10 is supported via left/right auxiliary front wheels 12. A body 20 is rotatably mounted to the suction apparatus 10 and disposed with a filter for collecting dust and the like sucked through a suction opening of the suction apparatus 10 according to suction force from driving means (not shown). The body 20 is supported on rear wheels 21 disposed left and right sides thereof.

Furthermore, the body 20 is provided thereon with a handle member 30 and a suction hose 40. Height adjustable apparatus 100 is cooperatively disposed at the suction body 10 and left and right sides of the body 20 in order to automatically adjust the height of the apparatus 10 above the floor surface.

The height adjustable apparatus 100 includes a bush 120 mounted to the body 20 via screws 110 and rotatably receiving a motor shaft (A). A height adjusting bracket 140 is disposed in front of the bush 120 at a predetermined space and a flange unit 141 thereof is secured by screws 130 to an inner wall of the suction apparatus 10. The bracket 140 includes a slot 142 inclined slightly relative to vertical and horizontal directions and enabling the motor shaft (A) to be inserted thereinto for movement in left, right, up, and down directions. The bracket 140 also includes a wavy guide slot 143 to receive a cylindrical roller 160 rotatably coupled to a protrusion 22 mounted at a side wall of the body 20 via screws 150. The reference numeral 144 designates a hole into which a screw 130 is inserted. The roller 160 and the slot 143 define a pin-and-slot connection between the body 20 and the suction apparatus 10.

Figure 5:
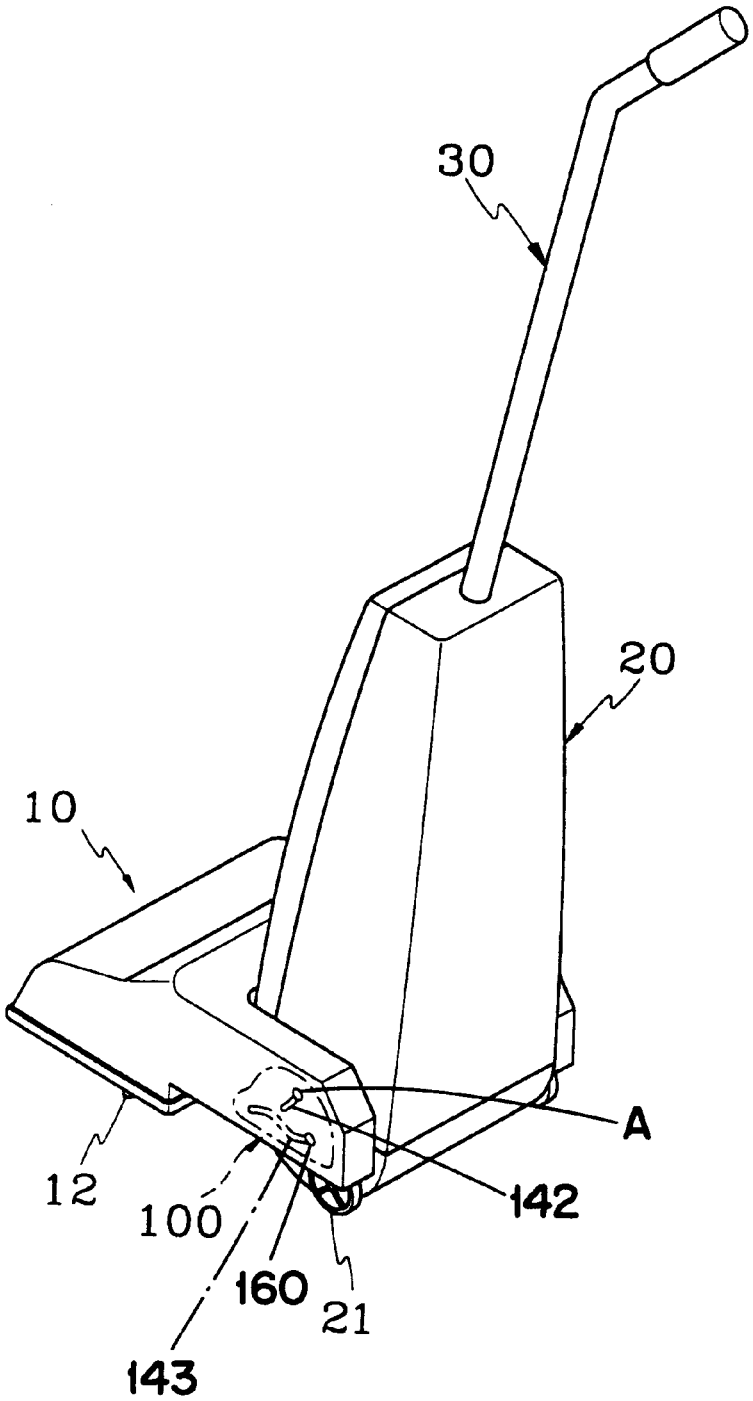
FIG. 5 is a perspective view for illustrating a height adjustable apparatus according to a first embodiment of the present invention.
Figure 6:
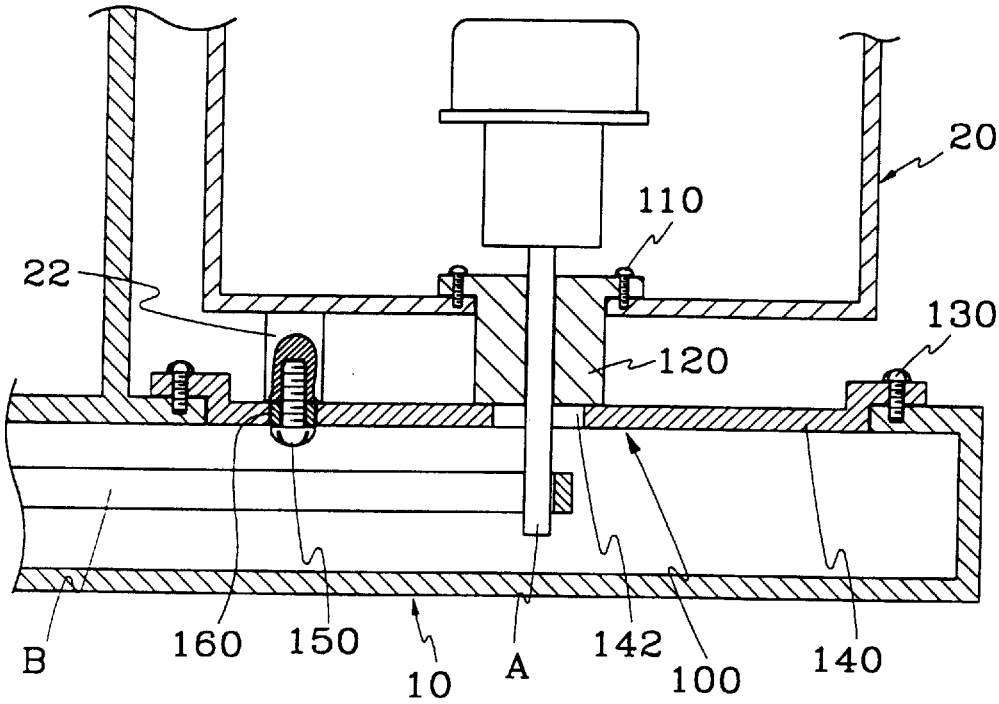
FIG. 6 is a sectional view for illustrating the height adjustable apparatus in FIG. 5.
Figure 7:
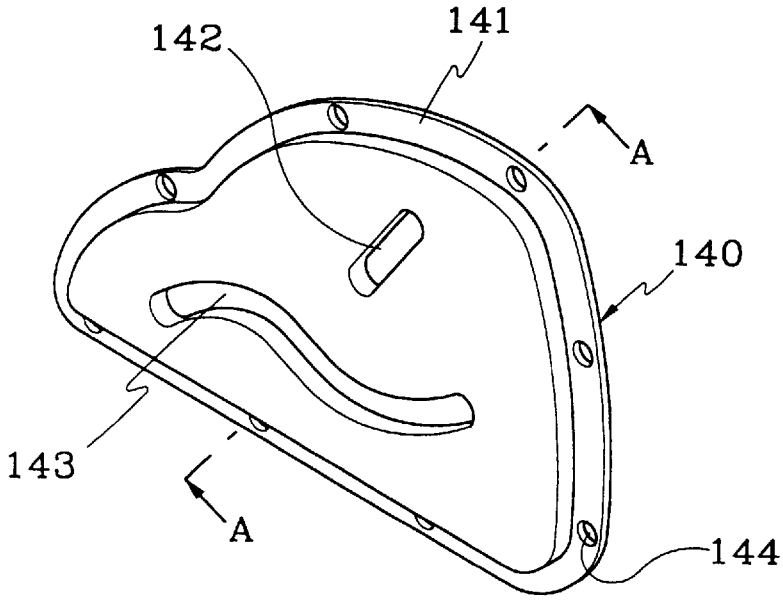
FIG. 7 is a perspective view for illustrating a height adjustable bracket according to the first embodiment of the present invention.
Figure 8:
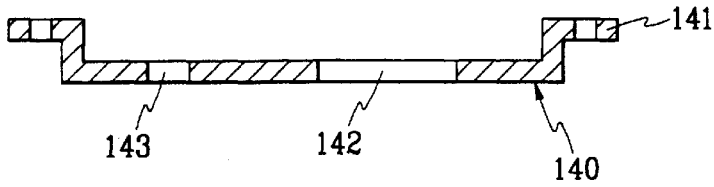
FIG. 8 is a section view taken along line A—A in FIG. 7.

When the handle 30 is oriented at a 90 degree angle to the floor, as shown in FIG. 5, the shaft A is disposed at an upper end of the slot 142, and the roller 160 is located at the right end of the slot 143. When power is applied to 25 activate the driving means in the body 20, and when the handle member 30 is held and inclined backward at a predetermined angle, the motor shaft (A) is moved down along the long hole 142 and simultaneously the roller 160 is moved from right to left in the guide slot 143.

Figure 4:
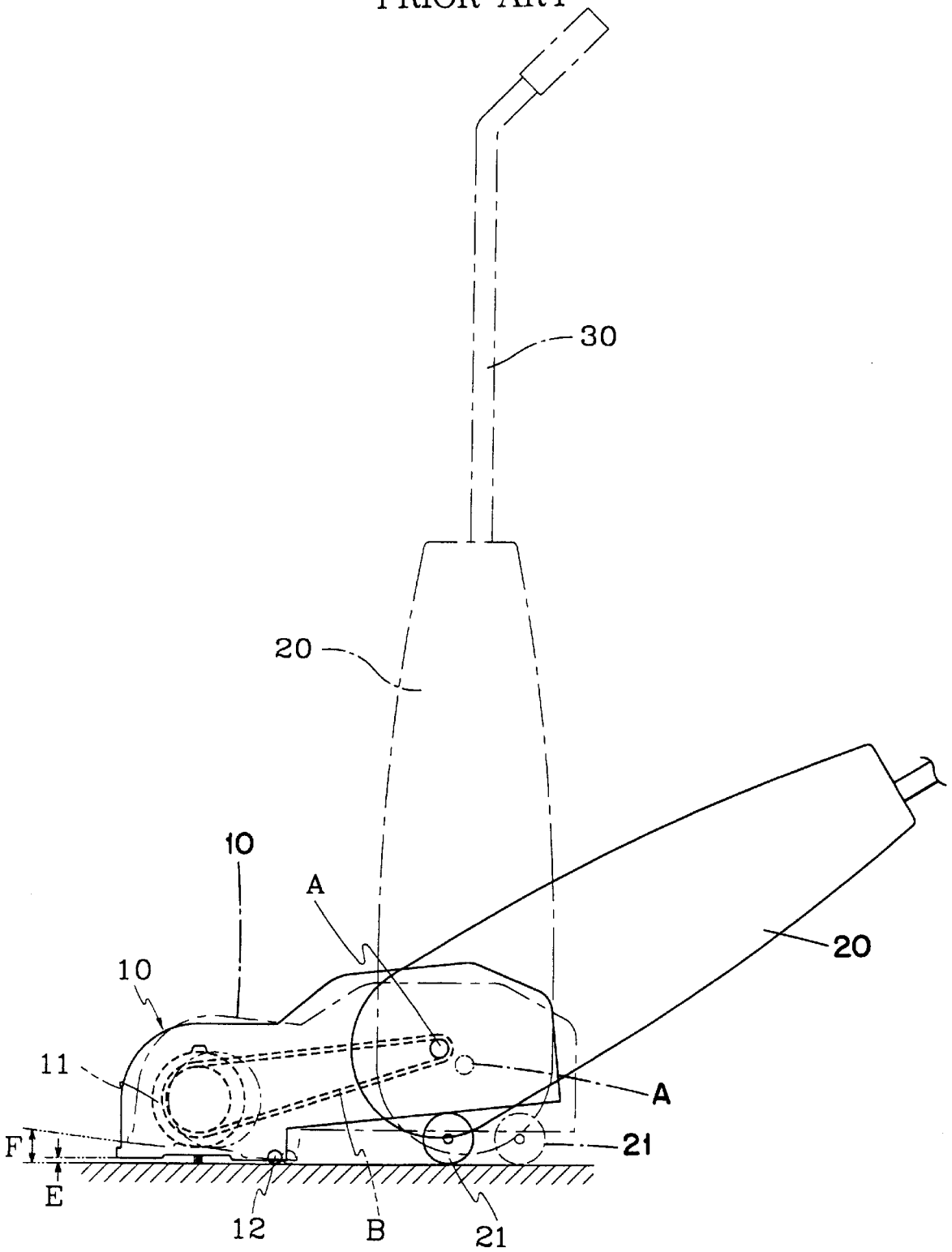
FIG.4 PRIOR ART
FIG. 4 is a schematic diagram for illustrating a use of an upright cleaner according to the prior art.

At this time, the wheels 21 on the body 20 are rotated clockwise about the shaft A, and when an angle formed by the body 20 and the floor surface has been changed from 90 degrees to 38.7 degrees, a gap formed by the suction apparatus 10 and the floor surface is changed from (F) in FIG. 4 to (E) because the wheels 21 move to a position beneath the slot A, causing the axle to be raised in the same manner as in FIG. 4.

Figure 12A:
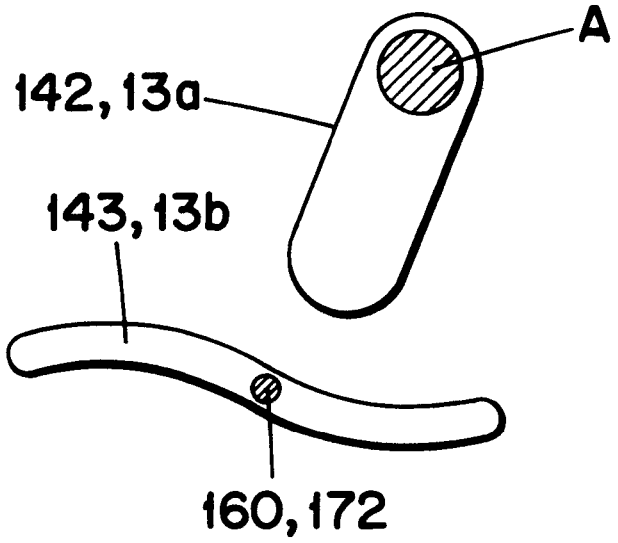
FIG. 12*a* is a schematic view showing the location of a shaft and a roller when a body is upright.

In other words, when the cleaning operation is performed at this time, the agitator 11 is rotated at a distance closest to the floor surface to thereby improve a cleaning efficiency. At the same time that the wheels 21 move to a position beneath the axle A, the roller 160 moves from the right side of the slot 143 to a middle area thereof, as shown in FIG. 12*a*.

Figure 9:
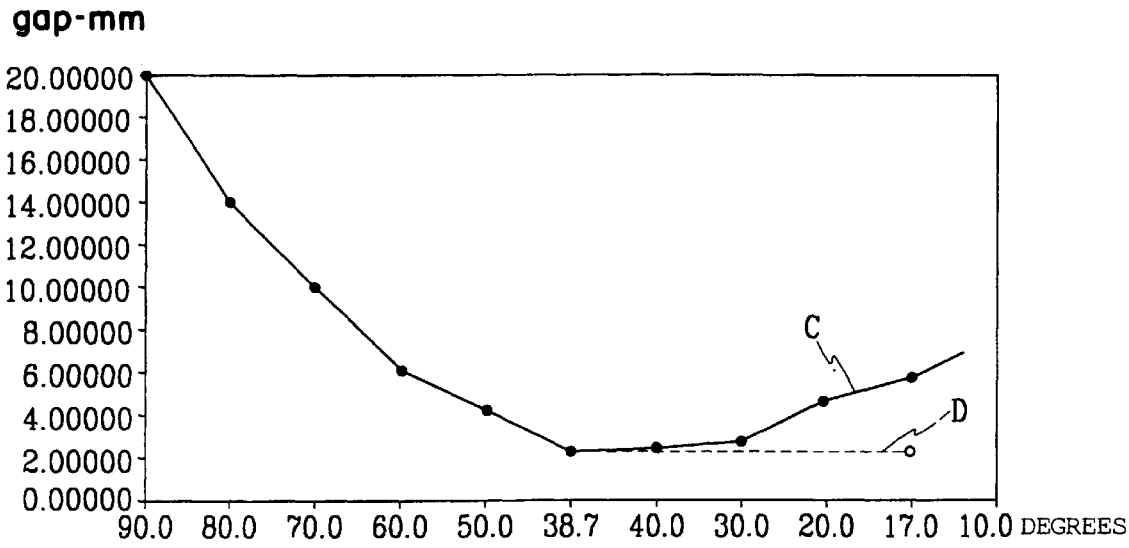
FIG. 9 is a graph for illustrating a front side of a suction apparatus being changed to a predetermined angle when a body of an upright cleaner according to the prior art and the present invention is inclined from 90 degrees to 17 degrees.
Figure 12B:
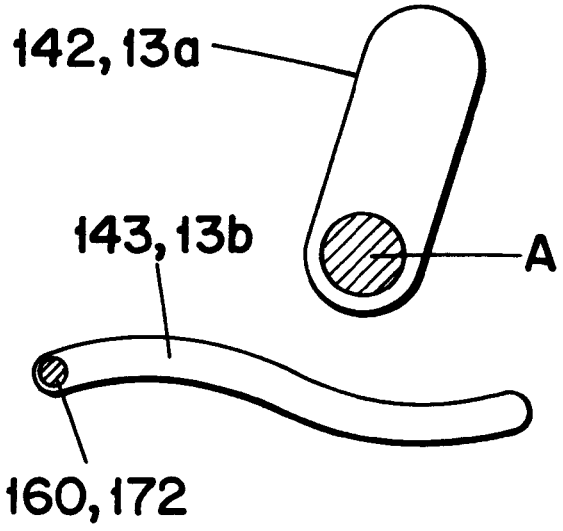
FIG. 12*b* is similar to FIG. 12*a* but showing the shaft and roller when the body has bee swung to a normal use position.

If the body 20 is further slanted backward to allow an angle formed by the body 20 and the floor surface to be changed from 38.7 degrees to 17 degrees, the motor shaft (A) is moved to a lowermost area of the long hole 142 and the roller 160 is concurrently moved to the left side of the guide slot 143 from the middle area thereof, as shown in FIG. 12*b*. Therefore, the angle (E) between the front side of the suction apparatus 10 and the floor surface is not changed, thereby maintaining the cleaning efficiency as is represented by broken lines in FIG. 9.

Next, when the body 20 is again rotated forwards to a position of 90 degrees, the gap (F) is recreated.

Figure 10:
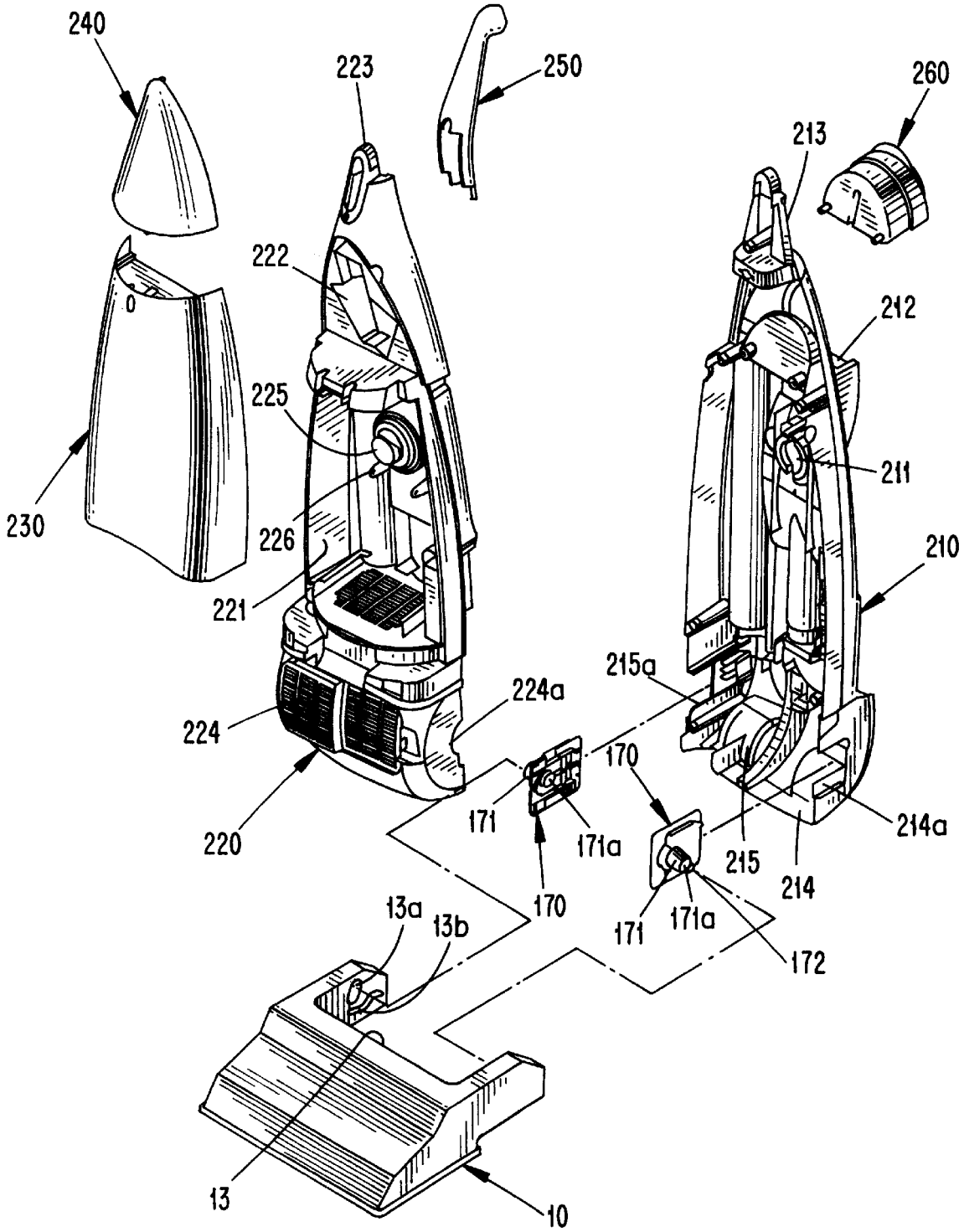
FIG. 10 is an exploded perspective view for illustrating an upright cleaner disposed with a height adjustable apparatus according to a second embodiment of the present invention.
Figure 11:
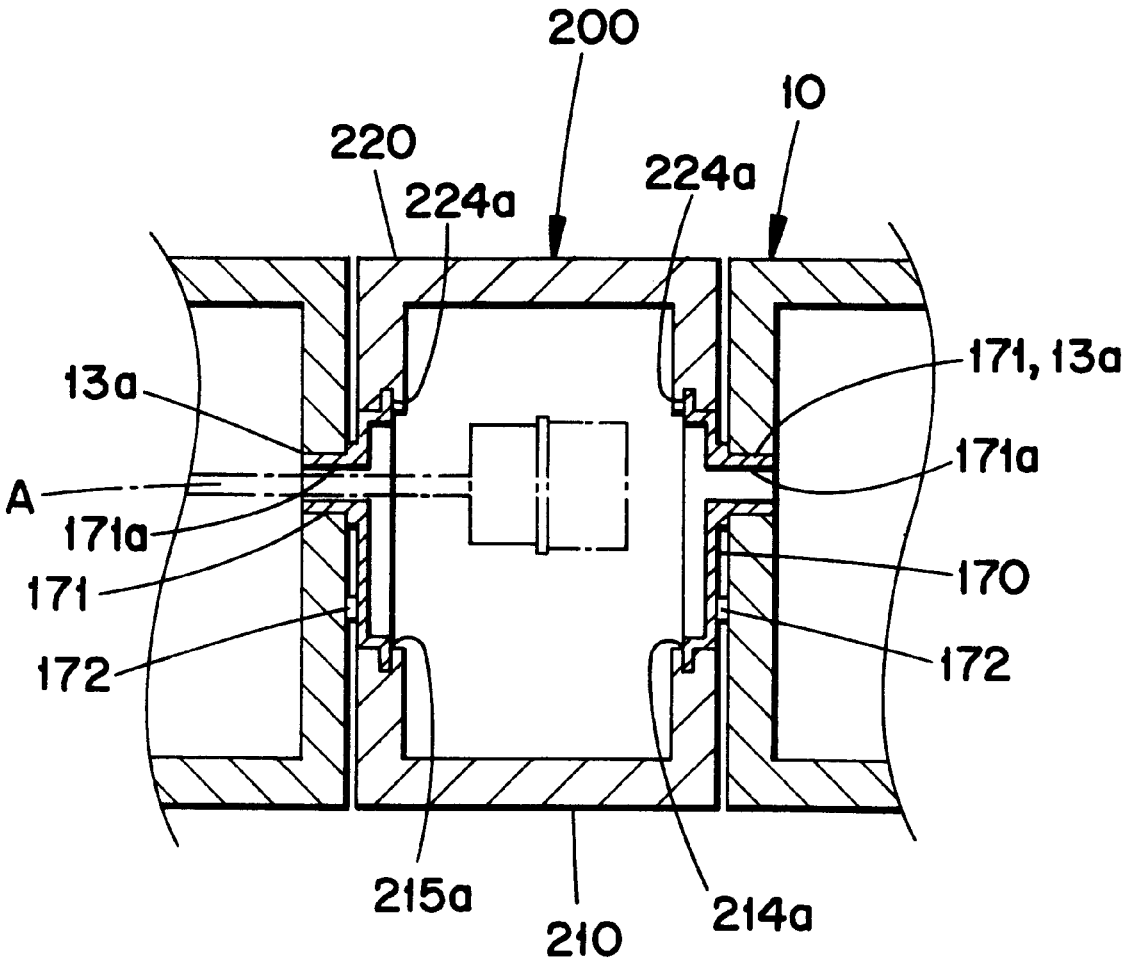
FIG. 11 is a sectional view for illustrating a body in FIG. 10 in horizontal line with a floor surface.

Furthermore, FIGS. 10 and 11 illustrate a second embodiment of the present invention by which a height adjustable apparatus is applicable to a mid-type upright cleaner, where, the height adjustable apparatus includes slots 13*a* each vertically formed at a predetermined incline on both sides of the suction apparatus 13 for accommodation of a body 200. A guide slot 13*b* is formed underneath the slot 13*a* in a predetermined wavy shape. Brackets 170 are coupled to respective sides of a lower portion of the body 200. Each bracket includes a hollow protruding house 171 and a protrusion 172 of round cross-section. The house 171 is inserted into the slot 13*a* and formed with a hole 171 a for the motor shaft to be inserted thereinto. The round protrusion 172 is inserted into the guide slot 13*b* for rolling movement, such that an angle formed by the suction apparatus and the floor surface is not changed even though an angle formed by the body 200 and the floor surface is inclined from 38.7 degrees to 17 degrees.

Each slot 13*b* and its associated protrusion 172 defines a pin-and-slot connection between the body 200 and the suction device 10.

The body 200 includes a lower body 210 formed, as illustrated in FIG. 10, with a connecting member coupling hole 211 into which a connecting member of connecting apparatus (not shown) is inserted. A storage cover disposal unit 212 is formed above the connecting member coupling hole 211 for receiving an accessory storage cover 260. A handle accommodation unit 213 is formed on the lower body 210 in such way that the handle member 250 can be placed on the storage cover disposal unit 212. A cord reel accommodation unit 214 is formed opposite to the handle accommodation unit 213, and a motor accommodation unit 215 is formed beside the cord reel accommodation unit 214. Lower bracket accommodation units 214*a* and 215*a* are formed on the lower body 210 in such way that the bracket 170 can be accommodated on outside walls of the cord reel accommodation unit 214 and the motor accommodation unit 215.

Furthermore, the body 200 includes a mid-body 220 provided with a dust envelope accommodation unit 221, a corner cleaning member accommodation unit 222 formed above the dust envelope accommodation unit 221, a switch accommodation unit 223 formed on the corner cleaning member accommodation unit 222 and for accommodating a switching unit (not shown), and a motor/cord reel cover unit 224 formed to envelop a cord reel (not shown) and a motor (not shown) disposed at the cord reel accommodation unit 214 and the motor accommodation unit 215. A board accommodation unit 225 is centrally formed at the dust envelope accommodation unit 221 to communicate with a connecting member coupling hole 211 at the lower body 210 to thereby allow a board of a dust envelope to be inserted thereinto. A dust envelope fixing member accommodation unit 226 is provided for mounting a dust envelope underneath a board accommodation unit 225. Upper bracket accommodating units 224*a* are disposed at both side walls of the motor/cord reel cover unit 224 for inserting and fixing an upper area of the bracket 170 disposed at the bracket lower accommodation units 214*a* and 215*a* of the motor accommodation unit 215 and at the cord reel accommodation unit 214.

Successively, a cord reel and a motor are accommodated at the cord reel accommodation unit 214 and the motor accommodation unit 215 at the lower body 210, and power facilities and the like for supplying driving power source to the motor and other electrical components are accommodated into left and right sides of the connecting member coupling hole 211. A lower section of the bracket 170 is fitted into the bracket lower accommodating units 214*a* and 215*a* of the motor accommodating unit 215 and the cord real accommodating unit 214 of the lower body 210.

Then, the cord reel and the motor are covered by the mid-body 220 lest they should be exposed to the outside, and an upper section of the bracket 170 is fitted into the bracket upper accommodation unit 224*a* formed at the motor/cord reel cover unit 224. The handle member 250 illustrated in FIG. 10 is mounted to the handle accommodation unit 213 of the lower body 210 and to the switch accommodation unit 223 of the mid-body 220.

Furthermore, the accessory storage cover 260 is assembled to the storage cover disposal unit 212 of the lower body 210, and a corner cleaning member (not shown) is inserted into the corner cleaning member accommodation unit 222 of the mid-body 220 and the cleaning member cover 240 is assembled thereon as illustrated in FIG. 10.

The dust envelope (not shown) is assembled via a dust envelope fixing member (not shown) disposed at the dust envelope fixing member accommodation unit 226 of the mid-body 220 to thereafter cause the board accommodation unit 225 to be inserted into a hole at the board. When the dust cover 230 illustrated in FIG. 10 is assembled to air-tightly close the dust envelope accommodation unit 221 of the mid-body 220, assembly of the body 200 is completed.

Then, the house 171 and the round protrusion 172 are inserted respectively into the guide slot 13*b* and the slots 13*a*.

When a cord reel of the upright cleaner thus constructed is pulled out and inserted into an outlet and a switch member (not shown) at the mid-body 220 is manipulated to apply electric power to the motor, the motor in the body 200 is rotated at a high speed to generate a strong vacuum suction force.

The vacuum suction force generated from the body 200 is transferred to the suction apparatus 10 via a connecting apparatus (not shown), such that dust, foreign objects and the like remaining on the floor surface is sucked in along with air sucked into the suction apparatus 10 to thereafter be introduced into the body 200 via a suction hose (not shown). The dust, foreign objects and the like infused into the body 200 are collected into the dust envelope disposed in a dust collecting chamber of the body 200.

Meanwhile, when the body 200 is slanted from an angle of 38.7 degrees formed by the floor surface and the body 200 to an angle of 17 degrees, the motor shaft (A) moves to a lowermost area of the slot 13*a* and simultaneously the house 171 moves from the mid section of the guide slot 13*b* to the left side thereof, such that an angle (E) as shown in FIG. 4 formed by the front side of the suction apparatus 10 and the floor surface is not changed, thereby preventing the cleaning efficiency from dropping.

Successively, when the body 200 is again rotated to 90 degrees, the inclined angle (E) is moved to the position (F) as shown in FIG. 4 to thereby prevent foreign objects from sticking to the agitator.

As apparent from the foregoing, there is an advantage in the upright cleaner according to the present invention in that a height adjustable apparatus is cooperatively disposed between the suction apparatus and left/right sides of the body for improving a suction efficiency by preventing an angle formed by a suction apparatus and a floor surface from being changed even though an angle formed by a body of the upright cleaner and the floor surface is further reduced after a gap between the suction apparatus and the floor surface on which dust is collected is minimized during the downward swinging of a handle.

In the above, the descriptions were made based on the specific embodiment of the present invention with reference to the attached drawings. However, it should be understood that the present invention is not to be limited to the specific embodiment, but various changes and modifications can be added without departing from the scope of the present invention as defined in the appended claims.

What is claimed is:

1. In an upright vacuum cleaner comprising a suction apparatus which includes a front portion forming a suction opening for directing suction toward a floor surface to suck foreign objects therefrom; and a body including a manually grippable handle attached to a lower portion thereof, support wheels attached to a lower portion thereof, and means for collecting dust received from the suction apparatus; the body being rotatably connected to the suction apparatus for up and down swinging movement relative thereto, whereby during downward swinging of the body from a generally upright position to an angle of use the support wheels are caused to move forwardly causing, a rear portion of the suction apparatus to move upwardly to cause the front portion of the suction apparatus to move downwardly to minimize a height of a gap between the suction opening and a floor surface, the improvement comprising means for maintaining the minimized height of the gap when the body is swung downwardly beyond the angle of use.

2. The apparatus according to claim 1 wherein the suction apparatus carries a rotatable dust agitator; the body including a motor having a drive shaft, the drive shaft extending through a first slot disposed in the suction apparatus and connected to the dust agitator; the first slot being inclined relative to both vertical and horizontal directions; the shaft being movable up and down in the slot during swinging movement of the body; the suction apparatus and the body being interconnected by a pin-and-slot connection which includes a wave-shaped second slot configured to resist downward movement of the rear portion of the suction apparatus when the body is swung downwardly beyond the angle of use.

3. The apparatus according to claim 2 wherein the body includes a hollow bush through which the drive shaft extends, the body further including a protrusion extending parallel to the shaft and carrying a rotatable roller, the suction apparatus including a bracket facing the bush and the roller, the first and second slots formed in the bracket and receiving the drive shaft and the roller, respectively, whereby the roller and the second slot define the pin-and-slot connection.

4. The apparatus according to claim 2 wherein the body comprises a lower body and a mid body connected together; there being two of the first slots, and those two first slots being disposed in the suction apparatus on opposite sides of the body; there being two of the second slots formed in the suction apparatus beneath respective ones of the first slots; two brackets disposed on opposite sides of the body, each bracket mounted in the lower body and the mid body and including a hollow protruding house and a protrusion of round cross-section; the drive shaft extending through respective hollow protruding houses and received in respective first slots; the protrusions of round cross-section received in respective second slots; each protrusion of round cross-section and its respective second slot defining the pin-and-slot connection.

5. The upright vacuum cleaner according to claim 2 wherein the suction apparatus carries support wheels disposed forwardly of the support wheels carried by the body and forwardly of the pin-and-slot connection.

* * * * *